US005382486A

United States Patent [19]

Yu et al.

[11] Patent Number: 5,382,486

[45] Date of Patent: Jan. 17, 1995

[54] ELECTROSTATOGRAPHIC IMAGING MEMBER CONTAINING CONDUCTIVE POLYMER LAYERS

[75] Inventors: Robert C. U. Yu, Webster; Geoffrey M. T. Foley, Fairport; William G. Herbert, Williamson; William W. Limburg, Penfield; Satchidanand Mishra, Webster; Richard L. Post, Penfield; Donald C. VonHoene, Fairport, all of N.Y.

[73] Assignee: Xerox Corporation, Stamford, Conn.

[21] Appl. No.: 38,447

[22] Filed: Mar. 29, 1993

[51] Int. Cl.[6] ..... G03G 15/00

[52] U.S. Cl. ..... 430/56; 430/57; 430/63; 430/69

[58] Field of Search ..... 430/56, 57, 63, 69

[56] References Cited

U.S. PATENT DOCUMENTS

| | | | |
|---|---|---|---|
| 4,618,552 | 10/1986 | Tanaka et al. | 430/60 |
| 4,654,284 | 3/1987 | Yu et al. | 430/59 |
| 4,664,995 | 5/1987 | Horgan et al. | 430/59 |
| 4,942,105 | 7/1990 | Yu | 430/59 |
| 5,002,845 | 3/1991 | Shimusa et al. | 430/58 |
| 5,008,167 | 4/1991 | Yu | 430/56 |
| 5,051,328 | 9/1991 | Andrews et al. | 430/56 |
| 5,063,128 | 11/1991 | Yuh et al. | 430/63 |
| 5,071,723 | 12/1991 | Koyama et al. | 430/58 |
| 5,096,792 | 3/1992 | Simpson et al. | 430/58 |
| 5,139,907 | 8/1992 | Simpson et al. | 430/58 |

FOREIGN PATENT DOCUMENTS 0462439 12/1991 European Pat. Off. .

OTHER PUBLICATIONS

Thermal Transitions and Mechanical Properties of Films of Chemicall Prepared Polyaniline, Y. Wei et al., Polymer, vol. 33, Number 2, pp. 314–322, 1992.

The Infuluence of Applied Potential on the Surface Composition of Electrochemically Synthesized Polyanilines, S. Mirreazaei et al., Synthetic Metals, 22, pp. 169–175, 1988.

Structure and Properties of Polyaniline as Modeled by Single-Crystall Oligomers, L. Shacklette et al., J. Chem. Phys. 88 (6), pp. 3955–3961, Mar. 15, 1988.

*Primary Examiner*—S. Rosasco

[57] ABSTRACT

An electrostatographic imaging member is disclosed including a supporting substrate, at least one electrically conductive layer, and at least one electrostatographic imaging layer capable of retaining an electrostatic latent image, wherein at least one electrically conductive layer of the imaging member includes an electrically conductive polymer. The electrically conductive layer may be a conductive ground plane, a ground strip layer and/or a conductive anti-curl back coating.

18 Claims, 5 Drawing Sheets

ELECTROSTATOGRAPHIC IMAGING MEMBER CONTAINING CONDUCTIVE POLYMER LAYERS

BACKGROUND OF THE INVENTION

This invention relates in general to electrostatography and, more specifically, to a flexible electrostatographic imaging member comprising a conductive polymer.

Flexible electrostatographic imaging members, e.g., belts, are well known in the art. Typical electrostatographic flexible imaging members include, for example, photoreceptors for electrophotographic imaging systems, and electroreceptors or ionographic imaging members for electrographic imaging systems. Both electrophotographic and ionographic imaging members are commonly utilized in either a belt or a drum configuration. When an electrostatographic imaging member is used in a belt form, it may be seamless or seamed. For electrophotographic applications, the imaging members preferably have a belt configuration. These belts often comprise a flexible supporting substrate coated with one or more layers of photoconductive material. The substrates may be inorganic such as electroformed nickel or organic such as a film forming polymer. The photoconductive coatings applied to these belts may be inorganic such as selenium or selenium alloys or organic. The organic photoconductive layers may comprise, for example, single binder layers in which photoconductive particles are dispersed in a film forming binder or multilayers comprising, for example, a charge generating layer and a charge transport layer. Since curling of imaging members often occurs after application of the charge transport layer coating, an anti-curl back coating is applied to the backside of the support substrate, opposite to the electrically active layers, to provide the desired imaging member flatness.

For electrostatographic imaging members in drum configuration, the supporting substrates used are either a rigid metallic or polymeric cylinder. The polymeric cylinder can be optically transparent, translucent, or opaque.

A photoconductive layer for use in xerography may be a homogeneous layer of a single material such as vitreous selenium or it may be a composite layer containing a photoconductor and another material. One type of composite photoconductive layer used in electrophotography is illustrated in U.S. Pat. No. 4,265,990. A photosensitive member is described in this patent having at least two electrically operative layers. One layer comprises a photoconductive layer which is capable of photogenerating holes and injecting the photogenerated holes into a contiguous charge transport layer. Various combinations of materials for charge generating layers and charge transport layers have been investigated. For example, the photosensitive member described in U.S. Pat. No. 4,265,990 utilizes a charge transport layer comprising a polycarbonate resin and one or more of certain aromatic amine compounds. Various generating layers comprising photoconductive layers exhibiting the capability of photogeneration of holes and injection of the holes into a charge transport layer have also been investigated. Typical photoconductive materials utilized in the generating layer include amorphous selenium, trigonal selenium, and selenium alloys such as selenium-tellurium, selenium-tellurium-arsenic, selenium-arsenic, and mixtures thereof. The charge generation layer may comprise a homogeneous photoconductive material or particulate photoconductive material dispersed in a binder. Other examples of homogeneous and binder charge generation layer are disclosed in U.S. Pat. No. 4,265,990. Additional examples of binder materials such as poly(hydroxyether) resins are taught in U.S. Pat. No. 4,439,507. The disclosures of the aforesaid U.S. Pat. Nos. 4,265,990 and 4,439,507 are incorporated herein in their entirety. Photosensitive members having at least two electrically operative layers as disclosed above in, for example, U.S. Pat. No. 4,265,990 provide excellent images when charged with a uniform negative electrostatic charge, exposed to a light image and thereafter developed with finely developed electroscopic marking particles. Generally, where the two electrically operative layers are positioned on an electrically conductive layer with the photoconductive layer sandwiched between a contiguous charge transport layer and the conductive layer, the outer surface of the charge transport layer is normally charged with a uniform electrostatic charge and the conductive layer is utilized as an electrode. In flexible electrophotographic imaging members, the electrode is normally a thin conductive coating supported on a thermoplastic resin web. Obviously, the conductive layer may also function as an electrode when the charge transport layer is sandwiched between the conductive layer and a photoconductive layer which is capable of photogenerating electrons and injecting the photogenerated electrons into the charge transport layer. The charge transport layer in this embodiment, of course, must be capable of supporting the injection of photogenerated electrons from the photoconductive layer and transporting the electrons through the charge transport layer.

Other electrostatographic imaging devices utilizing an imaging layer overlying a conductive layer include electrographic devices. For flexible electrographic imaging members, the conductive layer is normally sandwiched between a dielectric imaging layer and a supporting flexible substrate. Thus, generally, flexible electrophotographic imaging members generally comprise a flexible recording substrate, a thin electrically conductive layer, and at least one photoconductive layer and electrographic imaging members comprise a conductive layer sandwiched between a dielectric imaging layer and a supporting flexible substrate. Both of these imaging members are species of electrostatographic imaging members.

In order to properly image an electrostatographic imaging member, the conductive layer must be brought into electrical contact with a source of fixed potential elsewhere in the imaging device. This electrical contact must be effective over many thousands of imaging cycles in automatic imaging devices. Since the conductive layer is often a thin vapor deposited metal, long life cannot be achieved with an ordinary electrical contact element that rubs directly against the thin vapor deposited conductive layer. One approach to minimize the wear of the thin conductive layer is to use a grounding brush such as that described in U.S. Pat. No. 4,402,593. However, such an arrangement is generally not suitable for extended runs in copiers, duplicators and printers because wear problems are not entirely eliminated.

Still another approach to improving electrical contact between the thin conductive layer of flexible electrostatographic imaging members and a grounding means is the use of a relatively thick electrically conductive grounding strip layer in contact with the conductive layer and adjacent to one edge of the photoconductive or dielectric imaging layer. Generally the grounding strip layer comprises opaque conductive particles dispersed in a film forming binder. This approach to grounding of the thin conductive layer increases the overall life of the imaging layer because it is more durable than the thin conductive layer. However, such relatively thick ground strip layers are still subject to erosion and contribute to the formation of undesirable "dirt" in high volume imaging devices. Erosion is particularly severe in electrographic imaging systems utilizing metallic grounding brushes or sliding metal contacts or grounding blocks. Moreover mechanical failure is accelerated under high humidity conditions.

Also, in systems utilizing a timing light in combination with a timing aperture in the ground strip layer for controlling various functions of imaging devices, the erosion of the ground strip layer by devices such as stainless steel grounding brushes and sliding metal contacts is frequently so severe that the ground strip layer is worn away and becomes transparent thereby allowing light to pass through the ground strip layer and create false timing signals which in turn can cause the imaging device to prematurely shut down. Moreover, the opaque conductive particles formed during erosion of the grounding strip layer tends to drift and settle on other components of the machine such as the lens system, corotron, other electrical components to adversely affect machine performance. For example, at a relative humidity of 85 percent, the ground strip layer life can be as low as 100,000 to 150,000 cycles in high quality electrophotographic imaging members. Also, due to the rapid erosion of the ground strip layer, the electrical conductivity of the ground strip layer can decline to unacceptable levels during extended cycling.

Micro-crystalline silica particles have been added to ground strip layers to enhance mechanical wear life. Photoreceptors containing this type of ground strip are described in U.S. Pat. No. 4,664,995. The incorporation micro-crystalline silica particles into ground strip layers has produced excellent improvement in wear resistance. However, due to their extreme hardness, concentrations of silica over about 5 percent in ground strip layers has caused ultrasonic welding horns to rapidly wear as the horn is passed over the ground strip layer during photoreceptor seam welding processes. High welding horn wear is undesirable because horn service life is shortened, horn replacement is very costly, and production line down time for horn replacement is increased. An additional problem that is ground strip sensitivity to liquid developer. Exposure to an organic liquid carrier component of a liquid developer causes fatigue ground strip cracking to develop when the ground strip is flexed over small 19 mm diameter belt support roller.

In imaging systems using coherent light radiation to expose a layered member in an image configuration, optical interference occurring within said photosensitive member causes a plywood type of defect in output prints. There are numerous applications in the electrophotographic art wherein a coherent beam of radiation, typically from a helium-neon or diode laser, is modulated by an input image data signal. The modulated beam is directed (scanned) across the surface of a photosensitive medium. The medium can be, for example, an electrophotographic drum or belt in a xerographic printer, a photosensor CCD array, or a photosensitive film. Certain classes of photosensitive medium which can be characterized as "layered electrophotographic imaging members" have at least a partially transparent photosensitive layer overlying a conductive ground plane. A problem inherent in using these layered electrophotographic imaging members, depending upon their physical characteristics, is an interference effectively created by two dominant reflections of the incident coherent light on the surface of the electrophotographic imaging member; e.g., a first reflection from the top surface of the imaging member and a second reflection from the top surface of the relatively opaque conductive ground plane.

Another shortfall associated with the flexible electrostatographic imaging member belt that has been observed under machine operation conditions is that during electrophotographic imaging and belt cycling processes, the repetitive frictional action of the back side (e.g., the electrically insulative anti-curl back coating) of the imaging belt against the belt supporting rollers is seen to induce electrostatic charge build-up and attract loose toner particles as well as dirt debris to the back side of the belt. These particulate/debris accumulations, when pressed by belt support rollers, produce mechanical protuberances into the imaging belt and causes the development of imaging layer surface cracking. The imaging layer cracking are subsequently manifested as defects in copy print-out.

INFORMATION DISCLOSURE STATEMENT

U.S. Pat. No. 4,664,995 to Horgan et al, issued May 12, 1987— An electrostatographic imaging member is disclosed which utilizes a ground strip. The disclosed ground strip material comprises a film forming binder, conductive particles and microcrystalline silica particles dispersed in the film forming binder, and a reaction product of a bi-functional chemical coupling agent which interacts with both the film forming binder and the microcrystalline silica particles.

U.S. Pat. No. 4,654,284 to Yu et al, issued Mar. 31, 1987— An imaging member is disclosed comprising at least one flexible electrophotographic imaging layer, a flexible supporting substrate layer having an electrically conductive surface and an anti-curl layer, the anti-curl layer comprising a film forming binder, crystalline particles dispersed in the film forming binder and a reaction product of a bi-functional chemical coupling agent with both the film forming binder and the crystalline particles. This imaging member may be employed in an electrostatographic imaging process.

U.S. Pat. No. 4,942,105 to Yu, issued Jul. 17, 1990— A flexible electrophotographic imaging member is disclosed comprising at least one electrophotographic imaging layer, a supporting substrate layer having an electrically conductive surface and an anti-curl layer, the anti-curl layer comprising a film forming binder and from about 3 percent by weight to about 30 percent by weight, based on the total weight of said anti-curl backing layer, of a copolyester resin reaction product of terephthalic acid, isophthalic acid, ethylene glycol and 2,2-dimethyl-1-propane diol. This flexible electrophotographic imaging member is cycled in an electrostatographic imaging system to produce toner images.

U.S. Pat. No. 5,063,128 to Yu, et al., issued Nov. 5, 1991— A process is disclosed for preparing a device containing a continuous, semitransparent conductive layer including providing a substrate, applying to the substrate a coating containing a dispersion of conductive particles having an average particle size less than about 1 micrometer and having an acidic or neutral outer surface in a basic solution containing a film forming polymer dissolved in a solvent, and drying the coating to remove the solvent and form the continuous, semi-transparent conductive layer. The particle prepared by this process may be used in an electrophotographic imaging process.

U.S. Pat. No. 4,618,552 to S. Tanaka et al., issued Oct. 21, 1986— A light receiving member is described comprising an intermediate layer between a substrate and a metal of an alloy having a reflective surface and a photosensitive member, the reflective surface forming a light-diffusing reflective surface and the surface of the intermediate layer forming a rough surface. The light receiving member may have a photosensitive layer.

U.S. Pat. No. 5,096,792 to Y. Simpson et al., issued Mar. 17, 1992— A layered photosensitive imaging member is disclosed in which a ground plane surface is modified to have a rough surface by various deposition methods.

EPC 462,439 to S. Parik, et al. published Dec. 27, 1991— A layered photosensitive medium is modified to reduce the effects of destructive interference within the medium by reflection from coherent light incident thereon. The modification is to roughen the surface of the substrate upon which the ground plane is formed, the ground plane formed so as to conform to the underlying surface roughness.

U.S. Pat. No. 5,051,328 to J. Andrews et al., issued Sep. 24, 1991— A layered photosensitive imaging member is disclosed which is modified to reduce the effects of reflections from coherent light incident on a base ground plane. The modification involves forming the ground plane of a low reflecting material such as tin oxide or indium tin oxide. An additional feature is to add absorbing materials to the dielectric material upon which the ground plane is formed to absorb secondary reflections from the anti-curl back coating layer.

U.S. Pat. No. 5,139,907 to Y. Simpson et al., issued Aug. 18, 1992— A layered photosensitive imaging member is disclosed which is modified by forming a low-reflection layer on the ground plane.

"Thermal Transitions and Mechanical properties of Films of Chemically Prepared Polyaniline", Y. Wei et al., Polymer, Vol. 33, Number 2, pages 314–322, 1992— The mechanical and thermal properties of solution-cast films of chemically prepared electrically conductive polyaniline are described.

"The Influence of Applied Potential on the Surface Composition of Electrochemically Synthesized Polyanilines", S. Mirreazaei et al., Synthetic Metals, 22, pages 169–175, 1988"— X-ray photoelectron spectroscopy is used to monitor the surface composition of polyanilines electrochemically synthesized at various applied potentials.

"Structure and Properties of Polyaniline as Modeled by Single-Crystal Oligomers", L. Shacklette et al., J. Chem. Phys. 88 (6), pages 3955–3961, Mar. 15, 1998— A single-crystal charge-transfer complex of a phenyl-end-capped tetramer of polyaniline is synthesized and studied along with a similar dimer of polyaniline.

Thus, the characteristics of both flexible belt and rigid drum electrostatographic imaging members utilizing conductive layers and/or anti-curl back coating exhibit deficiencies which are undesirable in automatic, cyclic electrostatographic imaging systems.

SUMMARY OF THE INVENTION

It is an object of the invention to provide an electrostatographic imaging member which overcomes the above-noted disadvantages.

It is yet an object of this invention to provide an electrostatogaphic imaging member with a ground strip layer which exhibits greater resistance to delamination under high humidity environment.

It is another object of this invention to provide an electrostatographic imaging member with a ground strip layer which remains opaque for longer periods.

It is still yet another object of this invention to provide an electrostatographic imaging member with a ground strip layer that is more resistant to liquid developer.

It is also another object of this invention to provide an electrostatographic imaging member with a ground strip layer having improved adhesion.

It is still another object of this invention to provide an electrostatographic imaging member belt that extends the life of ultrasonic seam welding horns.

It is a further object of this invention to provide an electrostatographic imaging member that eliminates interference fringes that are manifested as wood grain print defects.

It is still another object of this invention to provide an electrostatographic imaging member belt with a conductive anti-curl back coating which maintains conductivity for longer periods of time to prevent electrostatic charge build-up during imaging belt machine operations.

The foregoing objects and others are accomplished in accordance with this invention by providing an electrostatographic imaging member comprising a supporting substrate, at least one electrically conductive layer, and at least one electrostatographic imaging layer capable of retaining an electrostatic latent image, wherein at least one electrically conductive layer of the imaging member comprises an electrically conductive polymer. The electrically conductive layer may be a conductive ground plane, a ground strip layer and/or a conductive anti-curl back coating.

For a typical flexible electrostatographic imaging member which utilizes an anti curl back coating to maintain imaging member flatness, an anti-curl back coating comprising an electrically conductive polymer may be used.

BRIEF DESCRIPTION OF THE DRAWINGS

A more complete understanding of the imaging device of the present invention purpose can be obtained by reference to the accompanying drawings wherein.

These figures merely schematically illustrate the invention and are not intended to indicate relative size and dimensions of electrostatographic imaging members or imaging apparatus or components thereof.

DETAILED DESCRIPTION OF THE DRAWINGS

For the sake of convenience, the invention will be described for electrophotographic imaging members only, though this invention includes ionographic imaging members as well electrostatographic imaging members in flexible belt or rigid drum configurations.

Figure 1:
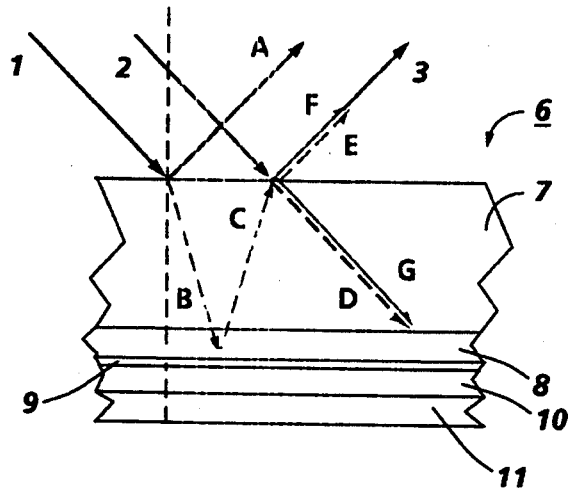
FIG. 1 PRIOR ART
FIG. 1 shows coherent light incident upon a prior art layered photosensitive medium leading to reflections internal to the medium.

Referring to FIG. 1, a coherent beam is incident on a layered electrophotographic imaging member 6 comprising a charge transport layer 7, charge generator layer 8, a conductive ground plane 9, a support substrate 10, and an anti-curl back coating 11. The interference effects can be explained by following two typical rays of the incident illumination. The two dominant reflections of a typical ray 1, are from the top surface of layer 7, ray A, and from the top surface of ground plane 9, ray C. The transmitted portion of ray C, ray E, combines with the reflected portion of ray 2, ray F, to form ray 3. Depending on the optical path difference as determined by the thickness and index of refraction of layer 7, the interference of rays F and E can be constructive or destructive when they combine to form ray 3. The transmitted portion of ray 2, ray G, combines with the reflected portion of ray C, ray D, and the interference of these two rays determines the light energy delivered to the generator layer 8. When the thickness is such that rays E and F undergo constructive interference, more light is reflected from the surface than average, and there will be destructive interference between rays D and G, delivering less light to generator layer 8 than the average illumination. When the transport layer 7 thickness is such that reflection is a minimum, the transmission into layer 8 will be a maximum. The thickness of practical transport layers varies by several wavelengths of light so that all possible interference conductions exist within a square inch of surface. This spatial variation in transmission of the top transparent layer 7 is equivalent to a spatial exposure variation of generator layer 8. This spatial exposure variation present in the image formed on the electrophotographic imaging member becomes manifest in the output copy derived from the exposed electrophotographic imaging member. The output copy exhibits a pattern of light and dark interference fringes which look like the grains on a sheet of plywood, hence the term "plywood effect" is generically applied to this problem. In the event that the ground plane 9 used for the imaging member fabrication is an optically transparent layer, the internal reflection that causes the interference effect for plywood formation will no longer be coming from the top surface of the ground plane but rather from the bottom surface of anti-curl back coating 11 below, due to the refractive index mismatch between the anti-curl back coating (e.g. having a refractive index is of 1.56) and the air (e.g. having a refractive index of 1.0) as the internal ray B passes through the optically clear substrate support 10 and the optically clear anti-curl back coating 11 before exiting to the air.

Figure 2:
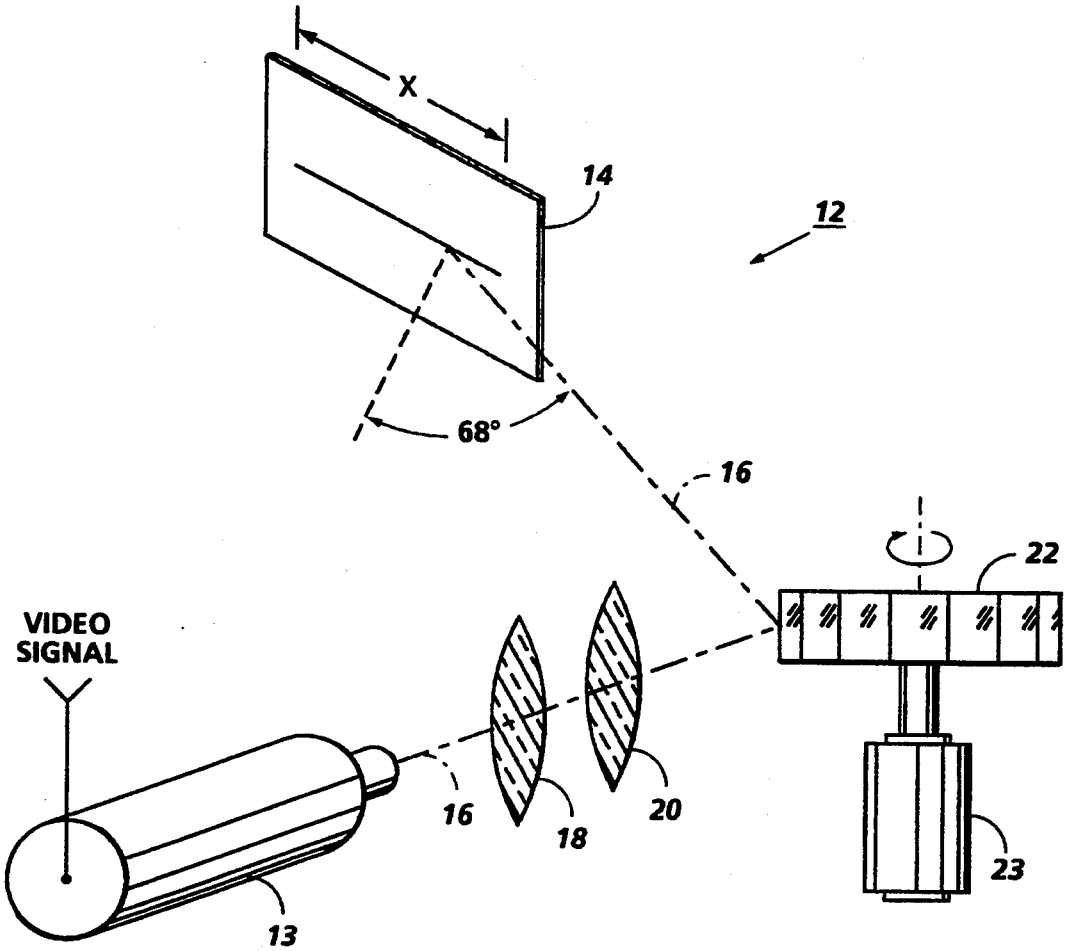
FIG. 2 is a schematic representation of an optical system incorporating a coherent light source to scan a light beam across an electrophotographic imaging member modified to reduce the interference effect according to the present invention.
Figure 5:
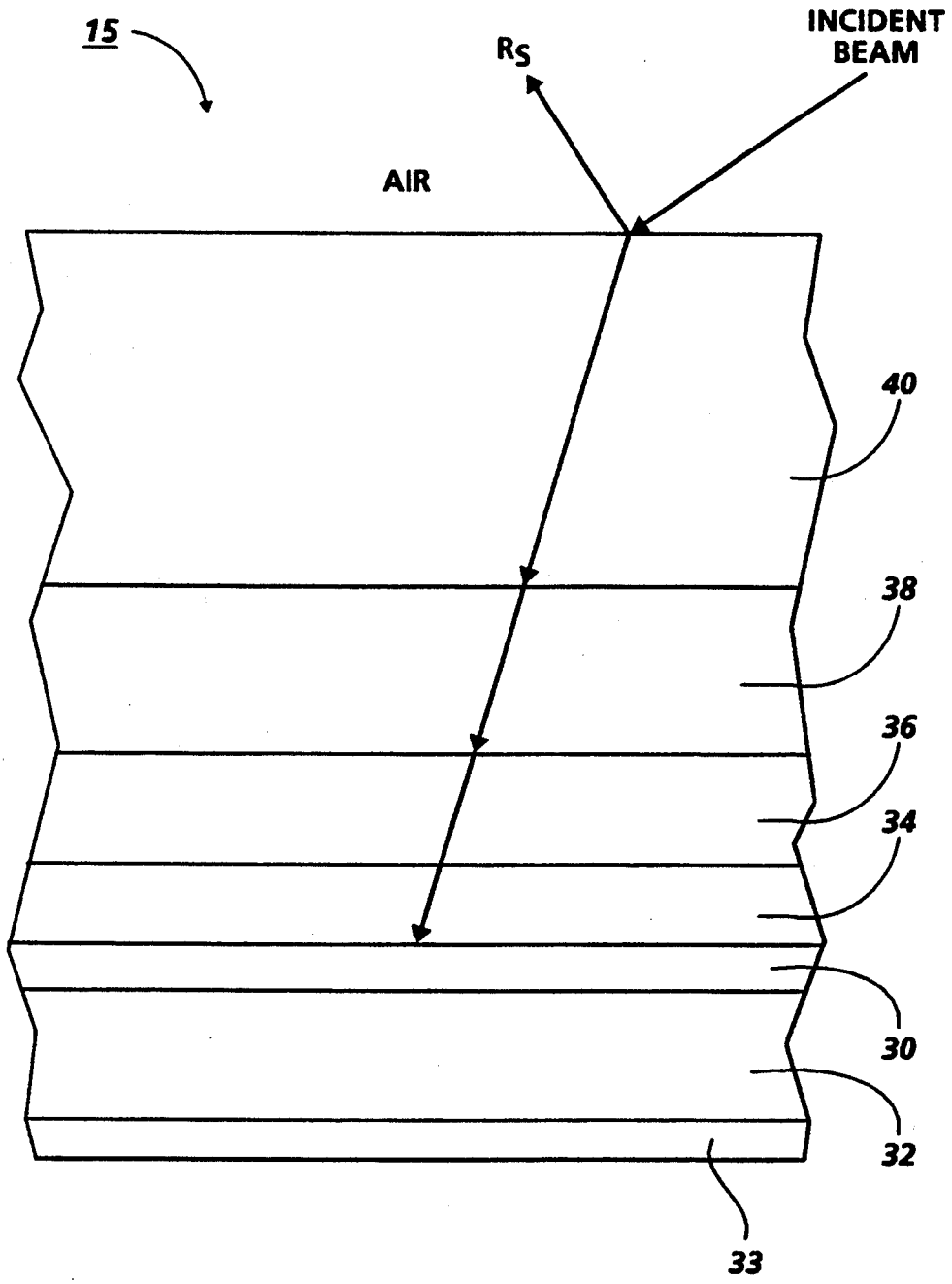
FIG. 5 is a partial cross-sectional view of the electrophotographic imaging member of FIG. 4 wherein a metallic ground plane is replaced by a coherent light absorbing conductive polymer layer according to the present invention.
Figure 6:
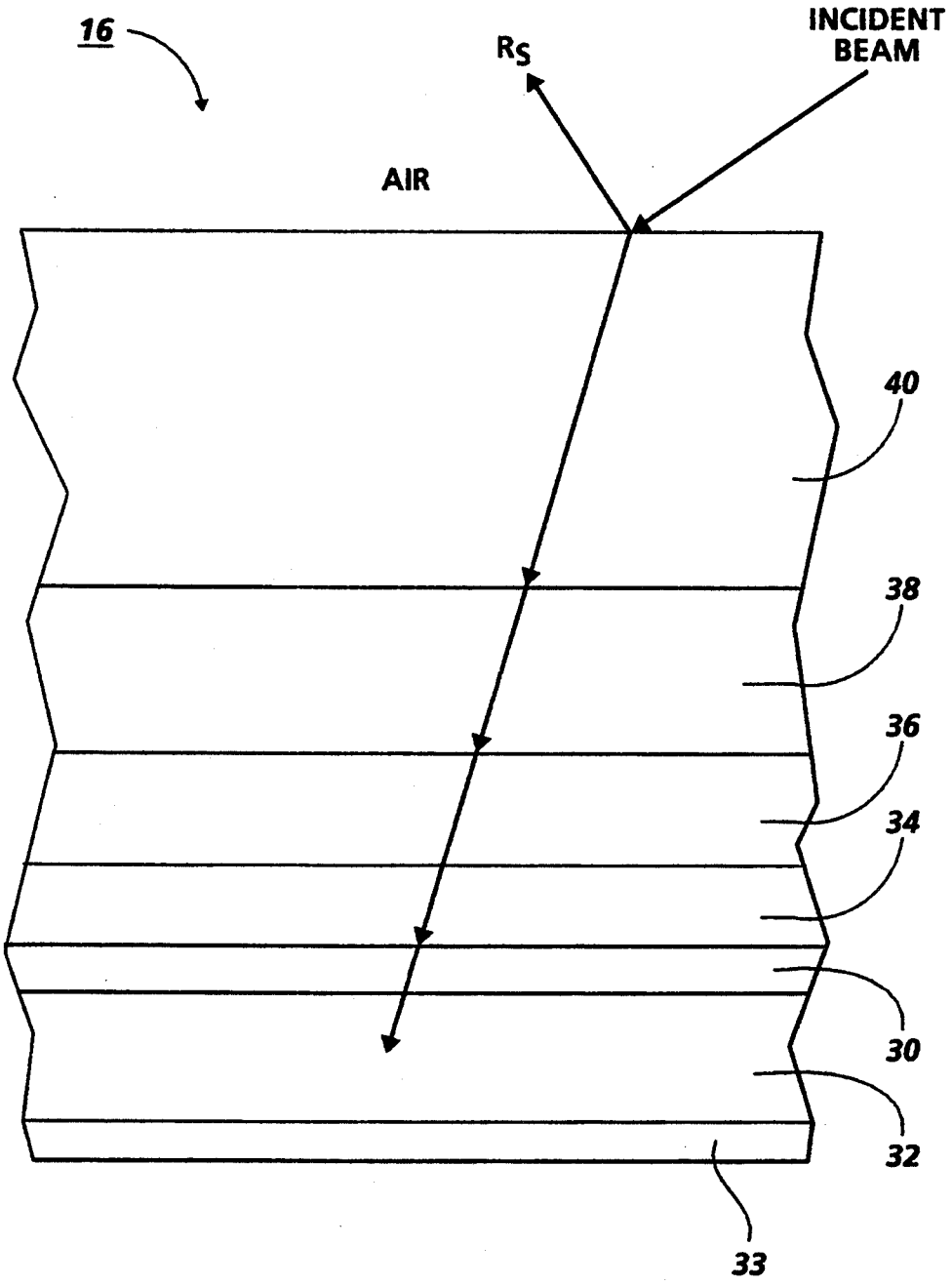
FIG. 6 is a partial cross-sectional view of the electrophotographic imaging member of FIG. 4 wherein the ground plane is an optically clear indium tin oxide and the anti-curl back coating is replaced by a conductive and coherent light absorbing anti-curl back coating of the present invention.

FIG. 2 shows an imaging system 12 wherein a laser 13 produces a coherent output which is scanned across an electrophotographic imaging member 14. Laser 13 is, for this embodiment, a helium neon laser with a characteristic wavelength of 0.63 micrometer, but may be, for example, an Al Ga As Laser diode with a characteristic wavelength of 0.78 micrometers. In response to video signal information representing the information to be printed or copied, the laser is driven in order to provide a modulated light output beam 16. The laser output, whether gas or laser diode, comprises light which is polarized parallel to the plane of incidence. Flat field collector and objective lens 18 and 20, respectively, are positioned in the optical path between laser 13 and light beam reflecting scanning device 22. In a preferred embodiment, device 22 is a multifaceted mirror polygon driven by motor 23, as shown. Flat field collector lens 18 collimates the diverging light beam 16 and field objective lens 20 causes the collected beam to be focused onto electrophotographic imaging member 14, after reflection from polygon 22. Electrophotographic imaging member 14 is a layered photoreceptor of the prior art having the structure shown in FIG. 4 and/or a modified layered photoreceptor according to the invention as shown in FIGS. 5 and 6, the latter two being capable of eliminating plywood interference fringes.

Figure 3:
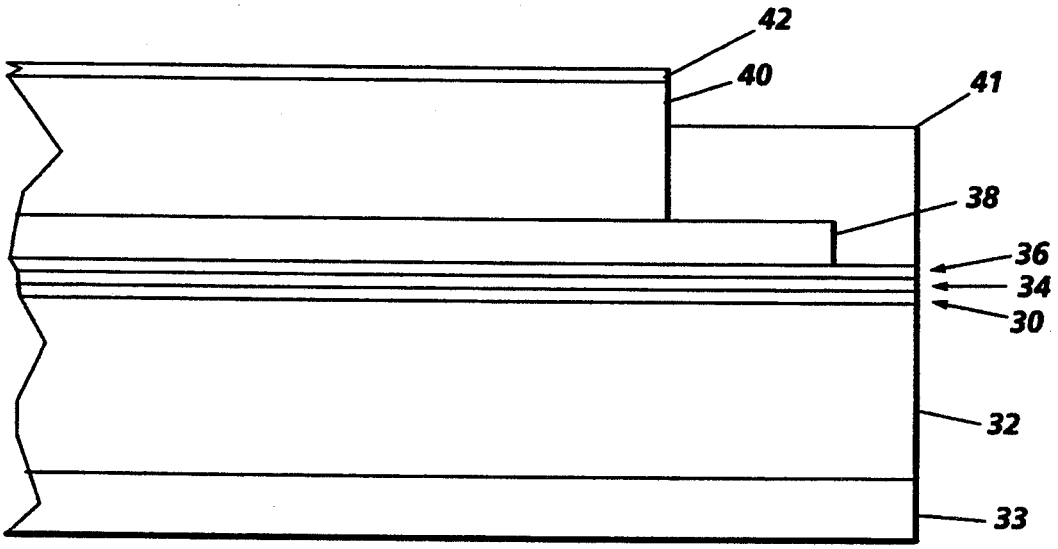
FIG. 3 is a full cross-sectional view of the configuration of a typical electrophotographic imaging member shown in FIG. 2.

In a typical electrophotographic imaging member shown in FIG. 3, the substrate 32 may be opaque or substantially transparent and may comprise numerous suitable materials having the required mechanical properties. Accordingly, the substrate may comprise a layer of an electrically non-conductive or conductive material such as an inorganic or an organic composition. As electrically non-conducting materials, there may be employed various resins known for this purpose including polyesters, polycarbonates, polyamides, polyurethanes, polysulfones, and the like which are flexible as thin webs. The electrically insulating or conductive substrate should be flexible and in the form of an endless flexible belt.

The thickness of the substrate layer depends on numerous factors, including beam strength and economical considerations, and thus this layer for a flexible belt may be of substantial thickness, for example, about 175 micrometers, or of minimum thickness less than 50 micrometers, provided there are no adverse effects on the final electrostatographic device. In one flexible belt embodiment, the thickness of this layer ranges from about 65 micrometers to about 150 micrometers, and preferably from about 75 micrometers to about 100 micrometers for optimum flexibility and minimum stretch when cycled around small diameter rollers, e.g. 19 millimeter diameter rollers. If desired, the substrate may be in the form of a drum which is rigid or flexible.

The conductive ground plane layer 30 may vary in thickness over substantially wide ranges depending on the optical transparency and degree of flexibility desired for the electrostatographic member. Accordingly, for a flexible photoresponsive imaging device, the thickness of the conductive layer may be between about 20 angstrom units to about 750 angstrom units, and more preferably from about 100 Angstrom units to about 200 angstrom units for an optimum combination of electrical conductivity, flexibility and light transmission. The flexible conductive layer may be an electrically conductive metal layer formed, for example, on the substrate by any suitable coating technique, such as a vacuum depositing technique. Typical metals include aluminum, zirconium, niobium, tantalum, vanadium and hafnium, titanium, nickel, stainless steel, chromium, tungsten, molybdenum, and the like. Generally, for rear erase exposure through an transparent rigid cylindrical support drum, a conductive layer light transparency of at least about 15 percent is desirable. The conductive layer need not be limited to metals. Other examples of conductive layers may be combinations of materials such as conductive indium tin oxide as a transparent layer for light having a wavelength between about 4000 Angstroms and about 7000 Angstroms or a transparent copper iodide (CuI) or a conductive carbon black dispersed in a plastic binder as an opaque conductive layer. A typical surfaced electrical resistivity for conductive layers for electrophotographic imaging members in slow speed copiers is about $10^3$ to $10^5$ ohms/square.

After formation of an electrically conductive surface, a hole blocking layer 34 may be applied thereto. Generally, electron blocking layers for positively charged photoreceptors allow holes from the imaging surface of the photoreceptor to migrate toward the conductive layer. Any suitable blocking layer capable of forming an electronic barrier to holes between the adjacent photoconductive layer and the underlying conductive layer may be utilized. The blocking layer may be nitrogen containing siloxanes or nitrogen containing titanium compounds as disclosed, for example, in U.S. Pat. Nos. 4,291,110, 4,338,387, 4,286,033 and 4,291,110. The disclosures of U.S. Pat. Nos. 4,338,387, 4,286,033 and 4,291,110 are incorporated herein in their entirety. The blocking layer may be applied by any suitable conventional technique such as spraying, dip coating, draw bar coating, gravure coating, silk screening, air knife coating, reverse roll coating, vacuum deposition, chemical treatment and the like. The blocking layer should be continuous and have a thickness of less than about 0.2 micrometer because greater thicknesses may lead to undesirably high residual voltage.

An optional adhesive layer 36 may be applied to the hole blocking layer. Any suitable adhesive layer well known in the art may be utilized. Typical adhesive layer materials include, for example, polyesters, polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like.

Any suitable photogenerating layer 38 may be applied to the adhesive layer which can then be overcoated with a contiguous hole transport layer as described hereinafter. Examples of typical photogenerating layers include inorganic photoconductive particles such as amorphous selenium, trigonal selenium, and selenium alloys selected from the group consisting of selenium-tellurium, selenium-tellurium-arsenic, selenium arsenide and mixtures thereof, and organic photoconductive particles including various phthalocyanine pigments such as the Xoform of metal free phthalocyanine described in U.S. Pat. No. 3,357,989, metal phthalocyanines such as vanadyl phthalocyanine and copper phthalocyanine, dibromoanthanthrone, squarylium, quinacridones, dibromo anthanthrone pigments, benzimidazole perylene, substituted 2,4-diamino-triazines disclosed in U.S. Pat. No. 3,442,781, polynuclear aromatic quinones, and the like dispersed in a film forming polymeric binder. Multi-photogenerating layer compositions may be utilized where a photoconductive layer enhances or reduces the properties of the photogenerating layer. Examples of this type of configuration are described in U.S. Pat. No. 4,415,639, the entire disclosure of this patent being incorporated herein by reference. Other suitable photogenerating materials known in the art may also be utilized, if desired.

Any suitable polymeric film forming binder material may be employed as the matrix in the photogenerating binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamide imides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in various amounts, generally, however, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition.

The photogenerating layer containing photoconductive compositions and/or pigments and the resinous binder material generally ranges in thickness of between about 0.1 micrometer and about 5.0 micrometers, and preferably has a thickness of from about 0.3 micrometer to about 3 micrometers. The photogenerating layer thickness is related to binder content. Higher binder content compositions generally require thicker layers for photogeneration. Thicknesses outside these ranges can be selected providing the objectives of the present invention are achieved.

Any suitable and conventional technique may be utilized to mix and thereafter apply the photogenerating layer coating mixture. Typical application techniques include spraying, dip coating, roll coating, wire wound rod coating, and the like. It is a general practice that the photogenerating layer is applied, intentionally, to be about 3 mm short from the edge of the substrate web to expose the adhesive layer for providing electrical contact between the ground plane and the ground strip layer to be coated later.

The active charge transport layer 40 may comprise an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer. An especially preferred transport layer employed in one of the two electrically operative layers in the multilayered photoconductor of this invention comprises from about 25 percent to about 75 percent by weight of at least one charge transporting aromatic amine compound, and about 75 percent to about 25 percent by weight of a polymeric film forming resin in which the aromatic amine is soluble.

The charge transport layer forming mixture preferably comprises an aromatic amine compound.

Examples of charge transporting aromatic amines represented by the structural formulae above for charge transport layers capable of supporting the injection of photogenerated holes of a charge generating layer and transporting the holes through the charge transport layer include triphenylmethane, bis(4-diethylamine-2-methylphenyl)phenylmethane; 4'-4''-bis(diethylamino)-2',2''-dimethyltriphenylmethane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3''-methylphenyl)-(1,1'-biphenyl)-4,4'-diamine, and the like dispersed in an inactive resin binder.

Any suitable inactive thermoplastic resin binder soluble in methylene chloride or other suitable solvent may be employed in the process of this invention to form the thermoplastic polymer matrix of the imaging member. Typical inactive resin binders soluble in methylene chloride include polycarbonate resin, polyvinylcarbazole, polyester, polyarylate, polyacrylate, polyether, polysulfone, polystyrene, and the like. Molecular weights can vary from about 20,000 to about 150,000.

Any suitable and conventional technique may be utilized to mix and thereafter apply the charge transport layer coating mixture to the charge generating layer. Typical application techniques include spraying, dip coating, roll coating, wire wound rod coating, and the like.

Generally, the thickness of the charge transport layer is between about 10 to about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layer is preferably maintained from about 2:1 to 200:1 and in some instances as great as 400:1.

The preferred electrically inactive resin materials are polycarbonate resins having a molecular weight from about 20,000 to about 150,000, more preferably from about 50,000 to about 120,000.

Examples of photosensitive members having at least two electrically operative layers include the charge generator layer and diamine containing transport layer members disclosed in U.S. Pat. Nos. 4,265,990, 4,233,384, 4,306,008, 4,299,897 and 4,439,507. The disclosures of these patents are incorporated herein in their entirety. The photoreceptors may comprise, for example, a charge generator layer sandwiched between a conductive surface and a charge transport layer as described above or a charge transport layer sandwiched between a conductive surface and a charge generator layer.

If desired, a charge transport layer may comprise electrically active resin materials instead of or mixtures of inactive resin materials with activating compounds. Electrically active resin materials are well known in the art. Typical electrically active resin materials include, for example, polymeric arylamine compounds and related polymers described in U.S. Pat. Nos. 4,801,517, 4,806,444, 4,818,650, 4,806,443 and 5,030,532. Polyvinylcarbazole and derivatives of Lewis acids described in U.S. Pat. No. 4,302,521. Electrically active polymers also include polysilylenes such as described in U.S. Pat. No. 3,972,717. Other polymeric transport materials include poly-1-vinylpyrene, poly-9-vinylanthracene, poly-9-(4-pentenyl)-carbazole, poly-9-(5-hexyl)-carbazole, polymethylene pyrene, poly-1-(pyrenyl)-butadiene, polymers such as alkyl, nitro, amino, halogen, and hydroxy substitute polymers such as poly-3-amino carbazole, 1,3-dibromo-poly-N-vinyl carbazole and 3,6-dibromo-poly-N-vinyl carbazole and numerous other transparent organic polymeric transport materials as Described in U.S. Pat. No. 3,870,516. The disclosures of each of the patents identified above pertaining to binders having charge transport capabilities are incorporated herein by reference in their entirety.

Optionally, an overcoat layer 42 may also be utilized to protect the charge transport layer and improve resistance to abrasion. In some cases an anti-curl back coating 33 may be applied to the rear side of the substrate to provide flatness and/or abrasion resistance. These overcoating and anti-curl back coating layers are well known in the art and may comprise thermoplastic organic polymers or inorganic polymers that are electrically insulating or slightly semi-conductive. Overcoatings are continuous and generally have a thickness of less than about 10 micrometers. The thickness of anti-curl back coatings should be sufficient to substantially balance the total curling forces of the imaging layer or layers on the opposite side of the supporting substrate layer.

Other layers such as a conventional electrically conductive ground strip layer 41 may be utilized, adjacent to the charge transport layer and along one edge of the belt, in contact with the adhesive layer and the charge generating layer to facilitate connection of the electrically conductive ground plane of the electrophotographic imaging member to ground or to an electrical bias through typical contact means such as a conductive brush, conductive leaf spring, and the like. Ground strip layers are well known and usually comprise conductive particles dispersed in a film forming binder.

Any suitable film forming binder may be utilized in the electrically conductive ground strip layer. For flexible imaging members, the thermoplastic resins should have $T_g$ of at least about 40° C. to impart sufficient rigidity, beam strength and non-tackiness to the ground strip layer. The film forming binder is preferably a thermoplastic resin. Typical thermoplastic resins include polycarbonates, polyesters, polyurethanes, acrylate polymers, cellulose polymers, polyamides, nylon, polybutadiene, poly(vinyl chloride), polyisobutylene, polyethylene, polypropylene, polyterephthalate, polystyrene, styrene-acrylonitrile copolymer, polysulfone, polyethersulfone, polyarylate, polyacrylate, and the like and mixtures thereof. A film forming binder of polycarbonate resin is particularly preferred because of its excellent adhesion to adjacent layers, ease if blending with other polymers in the ground strip formulation, formation of good dispersions of conductive particles and achievement of good mechanical strength and flexibility.

Any suitable electrically conductive particles may be used in the electrically conductive ground strip layer of this invention. Typical electrically conductive particles include carbon black, graphite, copper, silver, gold, nickel, tantalum, chromium, zirconium, vanadium, niobium, indium tin oxide and the like. The electrically conductive particles may have any suitable shape. Typical shapes include irregular, granular, spherical, elliptical, cubic, flake, filament, and the like. Preferably, the electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and to ensure uniform dispersion of the particles throughout the polymer matrix of the dried ground strip layer. The concentration of the conductive particles to be used in the ground strip depends on factors such as the conductivity of the specific conductive particles utilized. Generally, the concentration of the conductive particles in the ground strip is less than about 35 percent by weight based on the total weight of the dried ground strip in order to maintain sufficient strength and flexibility for the flexible ground strip layers. Graphite concentrations of about 25 percent by weight based on the total weight of the dried ground strip layer and about 20 percent by weight carbon black based on the total weight of the dried ground strip layer may be utilized. Sufficient conductive particle concentration is achieved in the dried ground strip layer when the surface resistivity of the ground strip layer is less than about $1\times10^6$ ohms per square and when the volume resistivity is less than about $1\times10^8$ ohm-cm. A volume resistivity of about $1\times10^4$ ohm-cm is preferred to provide ample latitude for variations in ground strip thickness and variations in the contact area between the outer surface of the ground strip layer and the electrical grounding device. Thus, a sufficient amount of electrically conductive particles should be used to achieve a volume resistivity less than about $1\times10^8$ ohm-cm. Excessive amounts of electrically conductive particles will adversely affect the flexibility of the ground strip layer for flexible photoreceptors. For example, a concentration of electrically conductive graphite particles greater than about 45 percent by weight or a concentration of electrically conductive carbon black particles greater than about 20 percent by weight begin to unduly reduce the flexibility of the electrically conductive ground strip layer. Under imaging belt machine function condition, the conductive ground strip layer is required to exhibit exceptionally long life on flexible imaging members which are cycled around small diameter guide and drive members many thousands of times.

For electrographic imaging members, a flexible dielectric layer overlying the conductive layer may be substituted for the active photoconductive layers. Any suitable, conventional, flexible, stretchable, electrically insulating, thermoplastic dielectric polymer matrix material may be used in the dielectric layer of the electrographic imaging member. Typical electrographic imaging members are described in U.S. Pat. No. 5,073,434, the entire disclosure thereof being incorporated herein by reference.

Figure 4:
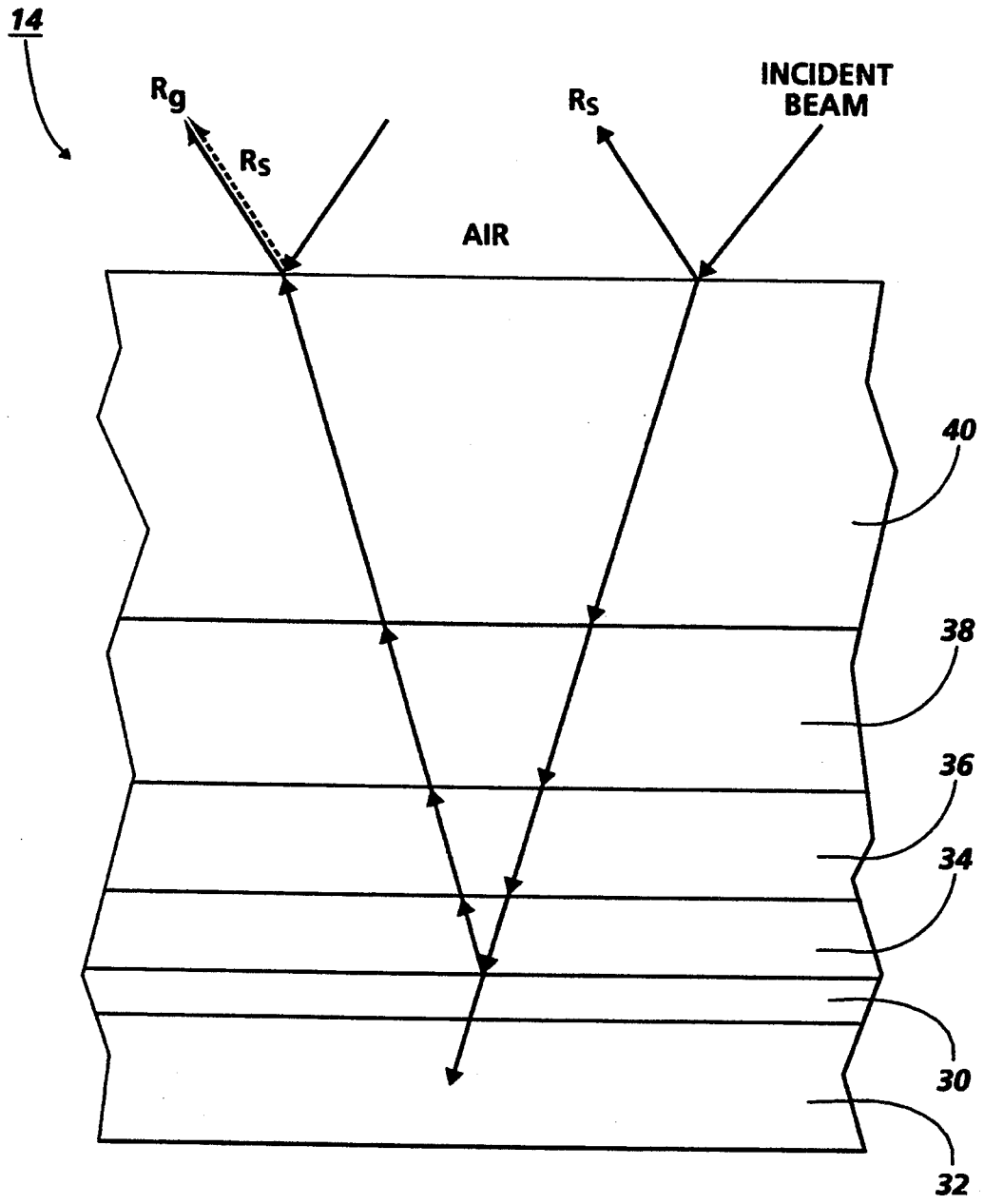
FIG. 4 is a partial cross-sectional view of the electrophotographic imaging member of FIG. 3 with conventional coating layers to illustrate a plywood effect.

Referring to FIG. 4, a light beam (e.g. 633 nm wavelength) interaction with a specific electrophotographic imaging member is schematically illustrated. The electrophotographic imaging member 14 is a flexible layered photoreceptor which includes a titanium conductive ground plane 30 formed on a polyethylene terephthalate dielectric supporting substrate 32. As is conventional in the art, ground plane 30 has formed thereon a polysiloxane layer 34, whose function is to act as a hole blocking layer. Formed on top of blocking layer 34 is a polyester adhesive interface layer 36.

The reflected beam is designated as $R_s$. As shown in FIG. 4, the incident light entering the charge transport layer 40 is bent, due to the refractive index difference between the air (having a value of 1.0) and layer 40 (having a value of 1.57). Since the refractive indexes of all the internal layers 34, 36, 38 and 40 are about the same, no significant internal refraction is expected and the light, therefore, travels in a straight line through these layers. Although the residual light energy (after large photon absorption by layer 38) that eventually reaches the thin ground plane 30 in partially transmitted through the ground plane, nonetheless, a greater fraction is reflected back to layer 40 and, designated as $R_g$, exits to the air. The emergence of the light energy $R_g$ from the photoreceptor 14 has direct interference with the reflected light $R_s$, resulting in the formation of the observed plywood fringes effect.

As described above, the present invention overcomes the shortcomings of the prior art by providing an imaging member with at least one electrically conductive layer comprising polyaniline. The electrically conductive layer is a conductive ground plane, a ground strip layer and/or a conductive anti-curl back coating. Thus, for electrostatographic imaging members of this invention, coatings comprising polyaniline are used to replace the conductive ground plane 30, ground strip layer 41 and/or a conductive anti-curl back layer 33 of the electrostatographic imaging members described in detail above. The polyaniline component of these layers is an electrically conductive polymer derived from a thermally stable emeraldine base polymer. The conductive form of acid-doped polyaniline is not soluble in any common organic solvent, however, it exists as ultrafine nanometer size dispersions in alcohol and other organic liquid carriers. Preferably, when formed as a layer having a thickness of less than about 1 micrometer on a supporting substrate, the fine polyaniline particle dispersions are sufficient without the presence of a film forming non-polyaniline polymer, to form upon drying, a thin continuous, homogenous polyaniline coating having a closely packed three-dimensional linking particle network. For thicker coating (greater than about 1 micrometer) applications, dispersion of polyaniline in solutions of conventional thermoplastic resins are recommended for coating compositions. With this approach, polyaniline exists as homogeneous dispersion of fine particles in a thermoplastic resin matrix in the resulting dried conductive coating layer. A typical weight average molecular weight for polyaniline is between about 20,000 and about 60,000. Any suitable liquid carrier may be utilized to form a dispersion of polyaniline, in embodiments where a liquid carrier is employed to form the thin continuous electrically conductive layer. Preferably, the liquid carrier is removable by evaporation to form the electrically conductive layer. Typical liquid carriers for polyaniline dispersions include, for example, isopropyl alcohol, toluene, dimethyl sulfoxide, tetrahydrofuran, and the like. The polyaniline acquires its intrinsic electrical conductivity characteristic through molecular acid doping. As employed herein, the expression "molecular acid doping" is defined as treating the base-form of a synthesized polyaniline in an aqueous acid solution, typically containing 1 molar hydrochloric acid, followed by filtration and drying under vacuum to yield the conductive form of polyaniline. Any suitable acid may be utilized for doping polyaniline. Typical acids include, for example, hydrochloric acid (HCl), sulfuric acid ($H_2SO_4$), methane sulfonic acid ($CH_3SO_3H$), and the like. The chemical preparation and electrochemical synthesis of polyaniline are described in publications such as "Thermal Transitions and Mechanical properties of Films of Chemically Prepared Polyaniline", Polymer, Vol. 33, Number 2, pages 314–322, 1992; "The Influence of Applied Potential on the Surface Composition of Electrochemically Synthesized Polyanilines", Synthetic Metals, 22, pages 169–175, 1988"; and "Structure and Properties of Polyaniline as Modeled by Single-Crystal Oligomers", J. Chem. Phys. 88 (6), pages 3955–3961, Mar. 15, 1998, the entire disclosures thereof being incorporated herein by reference. Although polyaniline is currently manufactured by Allied-Signal, Inc. and is commercially available under the product name Versicon polymer, a variety of liquid dispersions of polyaniline and a number of conductive polymer blends of polyaniline with various thermoplastic resins, such as, polyvinyl chloride, polycarbonate, polyester, nylon, and the like are available as Incoblends by Americhem, Inc. Polyaniline may be applied to form a thin continuous, homogeneous electrically conductive coating. Such a thin continuous, homogeneous electrically conductive coating is especially preferred for replacement of electrically conductive ground planes of prior art electrostatographic imaging members. When dried, electrically conductive layers of this invention comprising polyaniline particles dispersed in a matrix of a non-polyaniline film forming polymer having a dried coating layer thickness exceeding about one micrometer, the conductive layer should contain at least about 12 percent by weight polyaniline based on the total weight of the dried conductive layer to impart a volume resistivity of at least about $10^4$ ohm-cm to the layer. The conductive polyaniline polymer particles are hydrophobic, have good thermal stability up to 250° C., and exhibit excellent solvent resistance to many solvents employed for subsequently applied coatings. The electrically conductive polyaniline polymer particles should have a primary particle size less than the thickness of the electrically conductive layer and preferably less than about 100 nanometers for more uniform dispersions and greater electrical conductivity.

To illustrate a specific conductive ground plane layer application, a 3-mil thick biaxially oriented polyethylene substrate was overcoated with a thin polyaniline layer by spray coating using a liquid dispersion of 1.5 weight percent polyaniline in a liquid carrier mixture of isopropanol and dimethyl sulfoxide (DMSO), followed by drying at an elevated temperature to yield a highly electrically conductive, homogeneous, conductive semi-transparent coating with a greenish tint. For a specific illustration of a conductive anti-curl back coating layer application, polyaniline particles are dispersed in a solution of a non-polyaniline film forming polymer matrix by utilizing the non-polyaniline film forming polymer dissolved in methylene chloride or other suitable organic solvent to form a coating solution and then applied to the back side of an electrophotographic imaging member to counteract curling and provide a flat imaging member after drying at elevated temperature. In a similar example, an electrically conductive ground strip layer was also prepared by solution coating to give an opaque dried ground strip layer comprising a dispersion of polyaniline particles in a suitable film forming polymer matrix. More specifically, an electrically conductive ground strip layer of a preferred invention embodiment of this invention was coated with a solution containing polyaniline/acrylic polymer in toluene. The 17 micrometer thick ground strip layer, measured after drying at elevated temperature, contained polyaniline particles dispersed in an acrylic polymer matrix that gave excellent electrical conductivity and absolute opacity. Satisfactory results for the ground strip layer, the bulk electrical resistivity should less than about $10^8$ ohm-cm, and more preferably, less than about $10^6$ ohm-cm. A bulk electrical resistivity of less than $10^4$ ohm-cm gives optimum results. Other ground strip layers may comprise dispersions of polyaniline in a variety of polymer matrices such as polycarbonate, polyvinyl chloride, polystyrene, polyester, polyarylate, polysulfone, nylon or the like.

To illustrate elimination of the cause of the interference fringes in one embodiment of this invention, the ground plane layer may be modified to substantially suppress light energy reflection from ground plane 30 to a point that $R_g$ can virtually be removed. To achieve this result, a metal ground plane, such as a titanium layer, may be replaced, for example, with a 6,000 angstrom thick conductive polyaniline coating. Since polyaniline has an inherent green color, the residual 633 nm internal beam is absorbed when it reaches polyaniline ground plane of this invention as pictorially shown in the electrophotographic imaging member 15 of FIG. 5. For satisfactory applications, the electrically conductive polyaniline ground plane should have an electrical surface resistivity of less than $10^5$ ohms per square and, more preferably, a surface electrical resistivity of less than $10^4$ ohm per square. Alternatively, the base form of polyaniline may be dissolved in a suitable solvent, such as 1-methyl-2-pyrrolidinone (NMP), and the solution cast onto a suitable support substrate such as a polyester web. After drying at elevated temperature, the dried homogeneous polyaniline coating on the substrate can be exposed to the fumes of hydrochloric acid to convert it to an acid-doped, electrically conductive polyaniline ground plane.

If an optically clear ground plane 30 (e.g., cuprous iodide or indium tin oxide) is used in the photoreceptor device of FIG. 3, an anti-curl back coating layer configuration of this invention consisting of a dispersion of polyaniline in a polycarbonate (Makrolon, available from Bayer AG) and polyester (Vitel PE-200, available from Goodyear Rubber and Tire Co.) polymer blend may be used. This anti-curl back coating layer is translucent with a strong greenish hue that removes the internal light reflection according to the mechanism illustrated in the electrophotographic imaging member 16 of FIG. 6. This invention embodiment eliminates the plywood fringes problem. For satisfactory results, the anti-curl back coating of this invention should have an electrical bulk resistivity of less than $10^8$ ohm-cm. An electrical bulk resistivity of less than about $10^5$ ohm-cm is preferred.

If desired, any other suitable electrically conductive polymer may be substituted for the electrically conductive polyaniline described above. Other typical electrically conductive polymers include polyacetylene, polypyrrole, polythiophene, and the like.

This invention will further be described in the following, non-limiting examples, it being understood that these examples are intended to be illustrative only and that the invention is not intended to be limited to the materials, conditions, process parameters and the like recited therein.

COMPARATIVE EXAMPLE I

A photoconductive imaging member web was prepared, using a production coater, by providing a 200 angstrom thick titanium coated polyester substrate having a thickness of 76.2 micrometers (3 mils) and applying thereto, using a gravure applicator, a solution containing 50 gms 3-aminopropyltriethoxysilane, 50.2 gms distilled water, 15 gms acetic acid, 684.8 gms of 200 proof denatured alcohol and 200 gms heptane. This layer was then allowed to dry for 5 minutes at 135° C. in a forced air oven. The resulting blocking layer had a dry thickness of 0.05 micrometer.

An adhesive interface layer was then prepared by applying with a gravure applicator to the blocking layer a wet coating containing 5 percent by weight based on the total weight of the solution of polyester adhesive (DuPont 49,000, available for E.I. du Pont de Nemours & Co.) in a 70:30 volume ratio mixture of tetrahydrofuran/cyclohexanone. The adhesive interface layer was allowed to dry for 5 minutes at 135° C. in a forced air oven. The resulting adhesive interface layer had a dry thickness of 0.07 micrometer.

The adhesive interface layer was thereafter coated with a photogenerating layer containing 7.5 percent by volume trigonal selenium particles, 25 percent by volume N,N'-diphenyl-N,N'-bis(3-methylphenyl)-1,1'-biphenyl-4,4'-diamine, and 67.5 percent by volume polyvinylcarbazole. This photogenerating layer was prepared by introducing 8 gms polyvinyl carbazole and 140 ml of a 1:1 volume ratio of a mixture of tetrahydrofuran and toluene into a 20 oz. amber bottle. To this solution was added 8 gms of trigonal selenium and 1,000 gms of ⅛ inch (3.2 millimeter) diameter stainless steel shot. This mixture was then placed on a ball mill for 72 to 96 hours. Subsequently, 50 gms of the resulting slurry were added to a solution of 3.6 gm of polyvinyl carbazole and 20 gms of N,N'-diphenyl-N,N'-bis(3-methylphenyl)-1,1'-biphenyl-4,4'-diamine dissolved in 75 ml of 1:1 volume ratio of tetrahydrofuran/toluene. This slurry was then placed on a shaker for 10 minutes. The resulting slurry was thereafter applied to the adhesive interface layer by extrusion coating to form a layer having a wet thickness of 0.5 mil (12.7 micrometers). However, a strip about 3 mm wide along one edge of the substrate, blocking layer and adhesive layer was deliberately left uncoated by any of the photogenerating layer material to facilitate adequate electrical contact by the ground strip layer that is applied later. This photogenerating layer was dried at 135° C. for 5 minutes in a forced air oven to form a dry thickness photogenerating layer having a thickness of 2.0 micrometers.

This coated imaging member web was simultaneously overcoated with a charge transport layer and a ground strip layer by co-extrusion of the coating materials. The charge transport layer was prepared by introducing into an amber glass bottle in a weight ratio of 1:1 N,N'-diphenyl-N,N'-bis(3-methylphenyl)-1,1'-biphenyl-4,4'-diamine and Makrolon R, a polycarbonate resin having a molecular weight of from about 50,000 to 100,000 commercially available from Farbensabricken Bayer A.G. The resulting mixture was dissolved in 15 percent by weight methylene chloride. This solution was applied on the photogenerator layer by extrusion to form a coating which upon drying had a thickness of 24 micrometers.

A strip about 3 mm wide of the adhesive layer left uncoated by the photogenerator layer was coated with a ground strip layer during the co-extrusion process. The ground strip layer coating mixture was prepared by combining 23.81 gms of polycarbonate resin (Makrolon 5705, 7.87 percent by total weight solids, available from Bayer AG), and 332 gms of methylene chloride in a carboy container. The container was covered tightly and placed on a roll mill for about 24 hours until the polycarbonate was dissolved in the methylene chloride. The resulting solution was mixed for 15–30 minutes with about 93.89 gms of a graphite dispersion (12.3 Percent by weight solids) of 9.41 parts by weight graphite, 2.87 parts by weight ethyl cellulose and 87.7 parts by weight solvent with the aid of a high shear blade disperser in a water cooled, jacketed container to prevent the dispersion from overheating and losing solvent. The resulting dispersion was then filtered and the viscosity was adjusted with the aid of methylene chloride. This ground strip layer coating mixture was then applied to the photoconductive imaging member to a form an electrically conductive ground strip layer having a dried thickness of about 14 micrometers. This ground strip may be electrically grounded by conventional means such as a carbon brush contact means.

The resulting photoreceptor device containing all of the above layers was annealed at 135° C. in a forced air oven for 5 minutes.

An anti-curl back coating was prepared by combining 88.2 gms of polycarbonate resin (Makrolon 5705, available from Bayer AG), 8 gms of polyester resin (Vitel PE-200, available from Goodyear Tire and Rubber Company) and 900.7 gms of methylene chloride in a carboy container to form a coating solution containing 8.9 percent solids. The container was covered tightly and placed on a roll mill for about 24 hours until the polycarbonate and polyester were dissolved in the methylene chloride. 4.5 gms of silane treated microcrystalline silica was dispersed in the resulting solution with a high shear disperser to form the anti-curl back coating solution. The anti-curl back coating solution was then applied to the rear surface (side opposite the photogenerator layer and charge transport layer) of the photoconductive imaging member web by extrusion coating and dried at 135° C. for about 5 minutes in a forced air oven to produce a dried film having a thickness of 13.5 micrometers.

COMPARATIVE EXAMPLE II

A 22.86 cm×30.48 cm (9 in.×12 in.) photoconductive imaging member was prepared by hand coating technique to give the same material structure and layer dimensions as described in COMPARATIVE EXAMPLE I, with the exception that the titanium ground plane was replaced with a 200 angstrom thick indium tin oxide layer and no ground strip layer was coated adjacent to the charge transport layer.

EXAMPLE III

A photoconductive imaging member was fabricated in exactly the same manner as described in COMPARATIVE EXAMPLE II, except that the indium tin oxide layer was substituted with a 6,000 angstrom thick conductive polyaniline coating having approximately 20 percent optical transparency and a distinctively greenish tint. The application of the conductive polyaniline ground plane was carried out by spray coating using a solution containing 1.5 weight percent polyaniline dispersion in 98.5 weight percent 2-propanol/dimethyl sulfoxide solvent mixture (#900132, available from Americhem, Inc.). The weight ratio of 2-propanol to dimethyl sulfoxide was 98:2.

EXAMPLE IV

A photoconductive imaging member was fabricated in exactly the same manner as described in COMPARATIVE EXAMPLE II, except that the anti-curl back coating was substituted with an invention anti-curl coating consisting of 23 weight percent of polyaniline dispersion in Makrolon/Vitel PE-200 blend. The anti-curl coating solution was prepared by dissolved 10 gms of compounded polymers (which consists of 23 weight percent of polyaniline dispersion in 75 weight percent polymer blend of 92 parts Makrolon/8 parts of Vitel PE-200) in 90 gms of methylene chloride. This coating solution was applied to the back side of the polyethylene terephthalate substrate, opposite to the side having the photo-electrical sensitive layers, using a 2.5 mil gap Bird applicator. The imaging member with the wet coating was then dried at 135° C. for 5 minutes to give a dry anti-curl back coating of approximately 14 micrometers in thickness. The anti-curl back coating of this invention was semi-transparent, greenish in color and had a bulk electrical resistivity (reciprocal of conductivity) of about 1.6 ohm-cm.

EXAMPLE V

A 3-mil thick 22.86 cm×30.48 cm (9 in.×12 in.) polyethylene terephthalate substrate was spray coated over with a 1.5 weight polyaniline (available from Americhem, Inc.) dispersion in isopropyl alcohol/dimethyl sulfoxide solvent mixture. The wet coating was dried for 15 minutes at 90° C. and followed by additional drying for 5 minutes at 135° C. in an air circulating oven to yield a greenish tinting, dried electrically conductive ground plane of approximately 6,000 Angstrom thickness. The surface electrical resistivity of the dried polyaniline ground plane was measured to be about $2.5\times10^3$ ohms per square.

The substrate having the electrically conductive polyaniline ground plane was then examined under a coherent light emitted from a low pressure sodium lamp. The original greenish color in the polyaniline coating was seen to immediately turn into a black appearance surface upon exposure to the coherent light source, indicating strong radiant energy absorption of the orange beam by the polyaniline ground plane. The interaction observed between the polyaniline ground plane and the coherent light suggests that the conductive polyaniline coating, when used as a ground plane for imaging member fabrication, is potentially capable for resolving the plywood interference print defect problem.

EXAMPLE VI

To evaluate the effectiveness of the present invention suppressing the plywood fringes formed during development, photoconductive imaging members of EXAMPLES I through IV were examined under a coherent light emitted from a low pressure sodium lamp source. In sharp contrast to the plywood woodgrain patterns observed in both control imaging members of COMPARATIVE EXAMPLES I and II, no appearance of plywood fringes was notable for both photoconductive imaging members of this invention in EXAMPLES III and IV utilizing a polyaniline ground plane or a polyaniline dispersion anti-curl back coating, respectively.

EXAMPLE VII

The anti-curl back coating of the photoconductive imaging members of EXAMPLES I and IV were tested for peel strength. Peel strength was determined by cutting a minimum of five 1.27 cm×15.24 cm (0.5 in.×6 in.) imaging member samples. For each sample, the anti-cur layer was partially stripped from the supporting polyethylene terephthalate substrate to about 3.5 in. from one end to expose part of the underlying polyethylene terephthalate substrate. The exposed surface of the substrate was secured to a 2.54 cm×15.25 cm×0.25 cm (1 in.×6 in.×0.1 in.) aluminum backing plate with the aid of two sided adhesive tape and the end of resulting assembly opposite the end from which the anti-curl back coating was not stripped was inserted into the upper jaws of an Instron Tensile Tester. The free end of the partially peeled anti-curl back coating was inserted into the low jaws of the Instron Tensile Tester. The jaws were then activated at a 2.54 cm/min. (1 in./min.) crosshead speed, a 5.08 cm/min. (2 in./min.) chart speed, and a load range of 200 gms to 180° peel the sample a distance of at least 5.08 cm (2 in.). The load recorded in the chart was divided by the width (1.27 cm) of the test sample to give the peel strength required for stripping the coating layer. The results for peel testing shown in the table below indicate that incorporation of polyaniline in the matrix of the anti-curl back coating produces no negative adhesion effect.

| EXAMPLE | ANTI-CURL LAYER | PEEL STRENGTH (gms/cm) |
|---|---|---|
| I | Control | 89.7 |
| IV | Invention | 91.2 |

EXAMPLE VIII

A control sample of ground strip layer was prepared by providing a titanium coated polyester substrate having a thickness of 3 mils and applying thereto, using a 0.5 mil gap Bird applicator, a solution containing 2.592 gms 3-aminopropyltriethoxysilane, 0.784 gm acetic acid, 180 gms of 190 proof denatured alcohol and 77.3 gms heptane. This layer was then allowed to dry for 5 minutes at room temperature and 10 minutes at 135° C. in a forced air oven. The resulting blocking layer had a dry thickness of 0.05 micrometer.

An adhesive interface layer was then prepared by applying to the blocking layer a coating having a wet thickness of 0.5 mil and containing 0.5 percent by weight based on the total weight of the solution of polyester adhesive (DuPont 49,000, available from E.I. du Pont de Nemours & Co.) in a 70:30 volume ratio mixture of tetrahydrofuran/cyclohexanone with a 0.5 mil gap Bird applicator. The adhesive interface layer was allowed to dry for 1 minute at room temperature and 5 minutes at 135° C. in a forced air oven. The resulting adhesive interface layer had a dry thickness of 0.07 micrometer.

The adhesive interface layer was thereafter coated with a ground strip coating mixture. A basic ground strip layer coating mixture was prepared by combining 5.25 gms of polycarbonate resin (Makrolon 5705, 7.87 percent by total weight solids, available from Bayer AG), and 73.17 gms of methylene chloride in a glass container. The container was covered tightly and placed on a roll mill for about 24 hours until the polycarbonate was dissolved in the methylene chloride. The resulting solution was mixed for 15–30 minutes with about 20.72 gms of a graphite dispersion (12.3 Percent by weight solids) of 9.41 parts by weight graphite, 2.87 parts by weight ethyl cellulose and 87.7 parts by weight solvent with the aid of a high shear blade disperser (Tekmar Dispax Dispersator) in a water cooled, jacketed container to prevent the dispersion from overheating and losing solvent. The resulting dispersion viscosity was adjusted to between 325–375 centipoises with the aid of methylene chloride. This ground strip layer coating mixtures were then applied to the surface of the adhesive interface layer using a 4.5 mil gap Bird applicator, and then dried at 135° C. for 5 minutes in an air circulating oven to yield a control test sample bearing an electrically conductive ground strip layer having a dried thickness of about 17 micrometers. This ground strip layer control had a bulk electrical conductivity of about 12 ohm-cm.

EXAMPLE IX

A ground strip test sample of this invention was prepared by providing a titanium coated polyester substrate having a thickness of 3 mils and applying thereto, using a 0.5 mil Bird applicator, a solution containing 2.592 gms 3-aminopropyltriethoxysilane, 0.784 gm acetic acid, 180 gms of 190 proof denatured alcohol and 77.3 gms heptane. This layer was then allowed to dry for 5 minutes at room temperature and 10 minutes at 135° C. in a forced air oven. The resulting blocking layer had a dry thickness of 0.05 micrometer.

An adhesive interface layer was then prepared by applying to the blocking layer a coating having a wet thickness of 0.5 mil and containing 0.5 percent by weight based on the total weight of the solution of polyester adhesive (DuPont 49,000, available from E.I. du Pont de Nemours & Co.) in a 70:30 volume ratio mixture of tetrahydrofuran/cyclohexanone with a Bird applicator. The adhesive interface layer was allowed to dry for 1 minute at room temperature and 5 minutes at 135° C. in a forced air oven. The resulting adhesive interface layer had a dry thickness of 0.07 micrometer.

The adhesive interface layer was thereafter coated with a ground strip coating solution consisting of a mixture of 9 gms of solid polyaniline dispersion/acrylic base polymer in 91 gms of toluene (available from Americhem, Inc.) and a solution of 1 gm Kodar PETG (available from Eastman Chemicals) dissolved in 12 gms of toluene, using a 4.5 mil gap Bird applicator. The wet coating was then dried at 135° C. for 5 minutes in the air circulating oven to give an invention ground strip layer of about 17.5 micrometers in dried thickness and a bulk electrical resistivity of about 1 ohm-cm.

EXAMPLE X

A strip test sample of this invention was prepared by providing a titanium coated polyester substrate having a thickness of 3 mils and applying thereto, using a 0.5 mil Bird applicator, a solution containing 2.592 gms 3-aminopropyltriethoxysilane, 0.784 gm acetic acid, 180 gms of 190 proof denatured alcohol and 77.3 gms heptane. This layer was then allowed to dry for 5 minutes at room temperature and 10 minutes at 135° C. in a forced air oven. The resulting blocking layer had a dry thickness of 0.05 micrometer.

An adhesive interface layer was then prepared by applying to the blocking layer a coating having a wet thickness of 0.5 mil and containing 0.5 percent by weight based on the total weight of the solution of polyester adhesive (DuPont 49,000, available from E.I. du Pont de Nemours & Co.) in a 70:30 volume ratio mixture of tetrahydrofuran/cyclohexanone with a Bird applicator. The adhesive interface layer was allowed to dry for 1 minute at room temperature and 5 minutes at 135° C. in a forced air oven. The resulting adhesive interface layer had a dry thickness of 0.07 micrometer.

The adhesive interface layer was thereafter coated with a ground strip coating solution consisting of 17.5 weight percent solid of polyaniline dispersion/acrylic base polymer and 82.5 weight percent toluene (available from Americhem, Inc.), using a 3-mil gap Bird applicator. The applied wet coating was then dried at 135° C. for 5 minutes in the air circulating oven to yield a ground strip test sample of this invention having a dry thickness of about 18 micrometers and a bulk electrical resistivity of about 0.31 ohm-cm.

EXAMPLE XI

A ground strip test sample of this invention was prepared by providing a titanium coated polyester substrate having a thickness of 3 mils and applying thereto, using a 0.5 mil Bird applicator, a solution containing 2.592 gms 3-aminopropyltriethoxysilane, 0.784 gm acetic acid, 180 gms of 190 proof denatured alcohol and 77.3 gms heptane. This layer was then allowed to dry for 5 minutes at room temperature and 10 minutes at 135° C. in a forced air oven. The resulting blocking layer had a dry thickness of 0.05 micrometer.

An adhesive interface layer was then prepared by applying to the blocking layer a coating having a wet thickness of 0.5 mil and containing 0.5 percent by weight based on the total weight of the solution of polyester adhesive (DuPont 49,000, available from E.I. du Pont de Nemours & Co.) in a 70:30 volume ratio mixture of tetrahydrofuran/cyclohexanone with a Bird applicator. The adhesive interface layer was allowed to dry for 1 minute at room temperature and 5 minutes at 135° C. in a forced air oven. The resulting adhesive interface layer had a dry thickness of 0.07 micrometer.

The adhesive interface layer was thereafter coated with a ground strip coating solution consisting of 10 gms of compounded polymers (consisting of 45 weight percent of polyaniline dispersion in 65 weight percent of 92 parts Makrolon/8 parts Vitel PE-200 polymer blend) in 90 gms of methylene chloride. The applied wet coating was then dried at 135° C. for 5 minutes in the air circulating oven to yield a ground strip layer of this invention having a dry thickness of about 17 micrometers and a bulk electrical resistivity of about 1.1 ohm-cm.

EXAMPLE XII

The ground strip test sample of EXAMPLES VIII through XI were tested and compared for the effect on horn wear when conductive polyaniline is present in the ground strip formulations during ultrasonic lap joint seam welding, using a 40 KHZ sonic frequency, to form a 10 inch length of welded seam. The exposed ground strip surface of all the test samples were overlapped and faced the horn during the welding process. When examined under 10×magnification, no horn wear was noticeable after 10 seam weldings were carried out for each ground strip test sample of all the EXAMPLES. These results indicate that utilization of an electrically conductive polymer, such as polyaniline, for electrostatographic imaging member ground strip layer formulations produces no deleterious impact on ultrasonic horn wear in seam welding.

When tested for ultimate tensile seam strength, all ground strip seams of this invention gave seam rupture strength equivalent to that obtained for the control seam fabricated using the standard ground strip formulation of the prior art.

EXAMPLE XIII

The conductive polyaniline ground plane sample of EXAMPLE V and the ground strip test samples of EXAMPLES VIII through XI were first stored under 105° C./85% RH to determine temperature/humidity effects on adhesion bond strength of the coating layer of each sample. A cross hatch pattern was first formed on the coating layer of each sample by cutting through the thickness of the coating layer with a razor blade. The cross hatch pattern consisted of perpendicular slices 5 mm apart to form tiny separate squares of the ground strip layer. After a 3-day storage at 105° C./85% RH, adhesive tapes were then pressed against each sample over the cross hatchings and thereafter peeled away from the layer. The tests were made with two different adhesive tapes. One tape was Scotch Brand Magic Tape #810, available from 3M Corporation having a width of 0.75 in. and the other tape was Fas Tape #445, available from Fasson Industrial Div., Avery International. After application of the tapes to the surface of each sample, one tape of each brand was peeled away in a direction perpendicular to the surface of the coating layer (90° peel) to a distance of about 2 inches and then the peeling was changed to direction parallel to the outer surface of the same tape still adhering to the surface of the coating layer to facilitate a 180° peel. Peeling off of the tapes in both directions failed to remove any of the coating layers from the underlying layers except for the control ground strip layer of the prior art thereby demonstrating excellent temperature/humidity resistance and superb adhesion bond strength of the conductive ground plane as well as the ground strip layer formulations of the present invention utilizing polyaniline to the underlying layers.

EXAMPLE XIV

To evaluate the effect of liquid ink exposure on ground strip layer fatigue cracking, a 2.54 cm×20.22 cm (1 in.×8 in.) test specimen was cut from each ground strip coating sample of EXAMPLES VIII through XI. The coating surface of the test specimens were smeared with Norpar 15, a high boiling (251° C., linear hydrocarbon solvent from EXXON Chemical) liquid ink carrier, with solvent exposure allowed to continue overnight prior to conducting tests for their respective dynamic fatigue endurance.

With a 0.455 kg (one pound) weight attached at one end of a specimen to provide a 0.179 Kg/cm (one lb./in.) width tension, the test sample was wrapped 180° around a 3.0 mm (0.12 in.) diameter freely rotatable roller and the opposite end of the test sample was griped by hand. Under these conditions, the test specimen was dynamically flexed back and forth over the roller by manually moving the hand up and down, at a rate of one flex per second, until coating surface cracking/delamination occurred. No surface fatigue cracking development was notable, under 10×magnification, for all the ground strips layer of this invention after 120 cycles of flexing except the standard ground strip layer control of EXAMPLE VIII. The results obtained demonstrate excellent solvent resistance of the polyaniline and, therefore, suitability for imaging member applications utilizing liquid developer system.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. An electrostatographic imaging member comprising a supporting substrate, at least one electrostatographic imaging layer capable of retaining an electrostatic latent image, and at least one electrically conductive layer, said at least one electrically conductive layer comprising electrically conductive molecular acid doped polyaniline.

2. An electrostatographic imaging member according to claim 1 wherein said at least one electrically conductive layer is an electrically conductive ground plane layer comprising said electrically conductive molecular acid doped polyaniline.

3. An electrostatographic imaging member according to claim 2 wherein said at least one electrically conductive ground plane layer consists essentially of said electrically conductive molecular acid doped polyaniline.

4. An electrostatographic imaging member according to claim 3 wherein said at least one electrically conductive ground plane layer has an electrical surface resistivity of less than $10^5$ ohms per square.

5. An electrostatographic imaging member according to claim 1 wherein said imaging member comprises an anti-curl backing layer on one side of said substrate opposite the side facing said imaging layer.

6. An electrostatographic imaging member according to claim 5 wherein said anti-curl backing layer is said at least one electrically conductive layer and consists essentially of said conductive molecular acid doped polyaniline dispersed in a film forming polymer matrix.

7. An electrostatographic imaging member according to claim 5 wherein said anti-curl backing layer is said at least one electrically conductive layer and comprises said electrically conductive molecular acid doped polyaniline.

8. An electrostatographic imaging member according to claim 6 wherein said electrically conductive molecular acid doped polyaniline is homogeneously dispersed in a film forming polymer matrix.

9. An electrostatographic imaging member according to claim 5 wherein said anti-curl backing layer has an electrical bulk resistivity of less than $10^8$ ohm-cm.

10. An electrostatographic imaging member according to claim 1 wherein said substrate is a flexible belt.

11. An electrostatographic imaging member according to claim 1 wherein said substrate is a rigid drum.

12. An electrostatographic imaging member according to claim 1 wherein said imaging member is an electrographic imaging member and said imaging layer comprises a dielectric imaging layer.

13. An electrostatographic imaging member according to claim 1 wherein said at least one electrically conductive layer has a volume resistivity of at least about $10^4$ ohm-cm and comprises at least about 12 percent by weight molecular acid doped polyaniline based on the total weight of said at least one conductive layer.

14. An electrostatographic imaging member according to claim 1 wherein an electrically conductive ground plane layer interposed between said supporting substrate and said electrostatographic imaging layer and said at least one electrically conductive layer is an electrically conductive ground strip layer comprising said electrically conductive molecular acid doped polyaniline, said ground strip layer being adjacent said electrostatographic imaging layer and in electrical contact with said electrically conductive ground plane layer.

15. An electrostatographic imaging member according to claim 14 wherein said electrically conductive ground strip layer has a bulk electrical resistivity of less than about $10^8$ ohm-cm and comprises said electrically conductive molecular acid doped polyaniline.

16. An electrostatographic imaging member according to claim 15 wherein said electrically conductive ground strip layer comprises said electrically conductive molecular acid doped polyaniline dispersed in a film forming polymer matrix.

17. An electrophotographic imaging member comprising an electrically conductive anti-curl backing layer, a supporting substrate, an electrically conductive ground plane layer, at least one electrostatographic imaging layer capable of retaining an electrostatic latent image, an electrically conductive ground strip layer adjacent said electrostatographic imaging layer and in electrical contact with said electrically conductive ground plane layer wherein at least one of said electrically conductive layers comprises an electrically conductive molecular acid doped polyaniline.

18. An electrophotographic imaging member comprising an electrically conductive anti-curl backing layer, a supporting substrate, an electrically conductive optically clear ground plane layer, at least one electrostatographic imaging layer capable of retaining an electrostatic latent image, an electrically conductive ground strip layer adjacent said electrostatographic imaging layer and in electrical contact with said electrically conductive ground plane wherein said electrically conductive anti-curl backing layer is a coherent light absorbing layer comprising an electrically conductive molecular acid doped polyaniline.

* * * * *